United States Patent [19]

Bunten

[11] Patent Number: 4,904,031

[45] Date of Patent: Feb. 27, 1990

[54] EARRING STORAGE DEVICE

[76] Inventor: Nancy L. Bunten, 4128 - 34th St., San Diego, Calif. 92104

[21] Appl. No.: 197,677

[22] Filed: May 23, 1988

[51] Int. Cl.[4] ..... A47B 53/00; B65D 5/50; A47F 5/03

[52] U.S. Cl. ..... 312/295; 206/45.15; 206/566; 211/13; 211/164

[58] Field of Search ..... 206/566, 486, 45.14, 206/45.19, 488, 45.15; 211/13, 60.1, 163, 164; 312/294, 295, 297, 298, 299, 304–306, 308, 312, 327, 328, 125, 135, 245

[56] References Cited

U.S. PATENT DOCUMENTS

| | | | |
|---|---|---|---|
| 2,145,599 | 1/1939 | Haumann | 312/305 |
| 2,514,795 | 7/1950 | Remke | 206/562 X |
| 2,962,156 | 11/1960 | Adams | 211/164 X |
| 3,399,781 | 9/1968 | Nalbandian | 312/135 X |
| 3,880,484 | 4/1975 | Sicina | 312/125 X |
| 3,997,050 | 12/1976 | Patterson | 211/163 X |
| 4,058,356 | 11/1977 | Michal | 312/305 |
| 4,141,453 | 2/1979 | Hanan | 211/163 |
| 4,181,224 | 1/1980 | Aber | 206/486 |
| 4,632,474 | 12/1986 | Ingersoll | 312/305 |
| 4,681,216 | 7/1987 | Simkins | 206/45.14 |

FOREIGN PATENT DOCUMENTS

| | | | |
|---|---|---|---|
| 2494576 | 5/1982 | France | 211/164 |

*Primary Examiner*—Bryon P. Gehman

*Attorney, Agent, or Firm*—Lewis E. Massie; David L. Baker

[57] ABSTRACT

An earring storage device with a rectangular boxlike base with a chamber extending from the top surface of the base. A half-section of a circular rigid disk is attached and normal to the top surface. The device has a plurality of quarter-sections of a circular rigid disk that revolve around a shaft affixed to the half-section. Attached to the top surface and extending over the quarter-sections is a semicircular cover that guides and axially space the quarter-sections. At least one of the quarter-sections has a magnetic surface and at least one of the quarter-sections may be made out of compressed fiber or cork. The half-section has a surface to which a plurality of pins are attached. The pins are attached at an upward angle so that the earrings have a tendency to slide down toward the base of the pins. The device provides easy access and viewing of the earrings.

2 Claims, 1 Drawing Sheet

EARRING STORAGE DEVICE

BACKGROUND OF THE INVENTION

1. Field of the Invention

This invention relates to a storage device for storing earrings with a rectangular boxlike base including a half-secton of a circular rigid disk support structure attached and normal to the top surface of the base a plurality of rotatable quarter-sections of a circular rigid disk providing easy access to stored items.

2. Description of Related Art

The storage device described by Ingersoll in U.S. Pat. No. 4,632,474 wherein a plurality of flat shelves rotating around a vertical axis surrounded by a cylindrical-like enclosure supporting jewelry items appears to be the most pertinent prior art of record.

SUMMARY OF THE INVENTION

It is an objective of the instant invention to provide an earring storage device wherein the stored items can be displayed and made easily accessible to the user.

An earring storage device is provided comprising a rectangular boxlike base with a chamber extending from a top surface of the rectangular boxlike base. There is a half-section of a circular rigid disk, with a plurality of pins attached to the half-section at an upward angle to the top surface of the base, attached and normal to the top surface with a hole near the vertex of the half-section. There is a plurality of quarter-sections of a circular rigid disk having a hole near the vertex of the quarter-sections of the rigid disk. Also, there is a shaft that passes through the hole of the half-section and of each quarter-section and around which the quarter-sections may rotate. A knob is placed on a end of the shaft. There is a semicircular cover attached to the top surface of the rectangular boxlike base and extending around the quarter-sections. A radius of the quarter-sections is less than a inside radius of the semicircular cover. Included are a plurality of semi-circular spacer tracks affixed to a inside perimeter of the semicircular cover for guiding and for providing axial spacing between the quarter-sections.

There may be at least one quarter-section with a magnetic surface and at least one quarter-section made out of compressed fiber or cork.

The earring storage device provides easy access and viewing to any earrings stored therein. The troughlike chamber extending from the top surface of the base provides a place to store items not placed on the quarter and -half sections. Earrings may be placed on the pins on the half-section. These pins are long enough to hang an earring on and are placed on the half-section at an upward angle so that the earrings have a tendency to slide down to the base of the pins. The magnetic surface of the quarter-sections will attract and hold any earring portions that are made of a suitable iron alloy. The earring posts may also be stuck into the quarter-sections made out of compressed fiber or cork.

DETAILED DESCRIPTION OF THE PREFERRED EMBODIMENT

Figure 1:
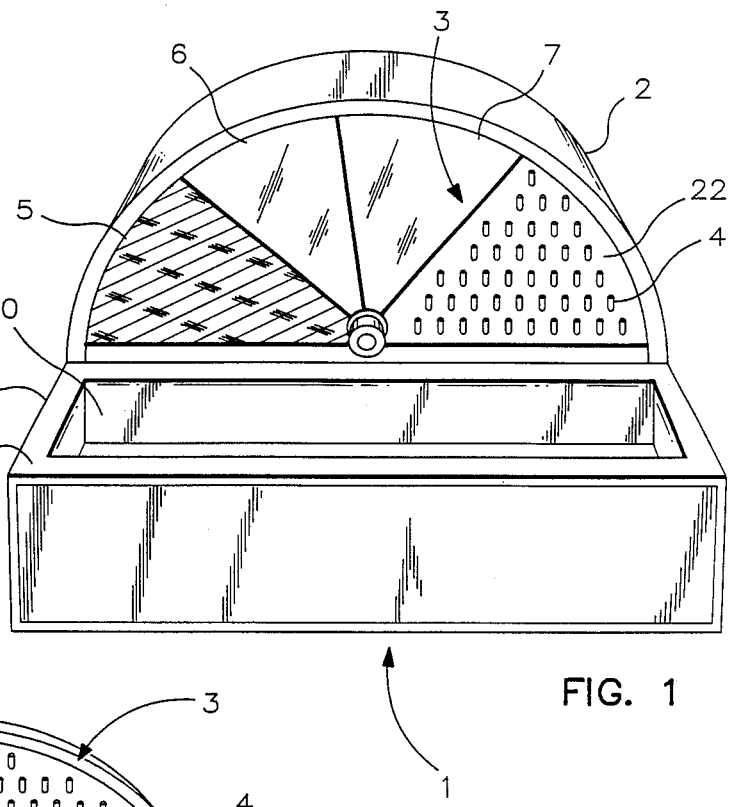
FIG. 1 is a top front perspective vie of the earring storage device.
Figure 2:
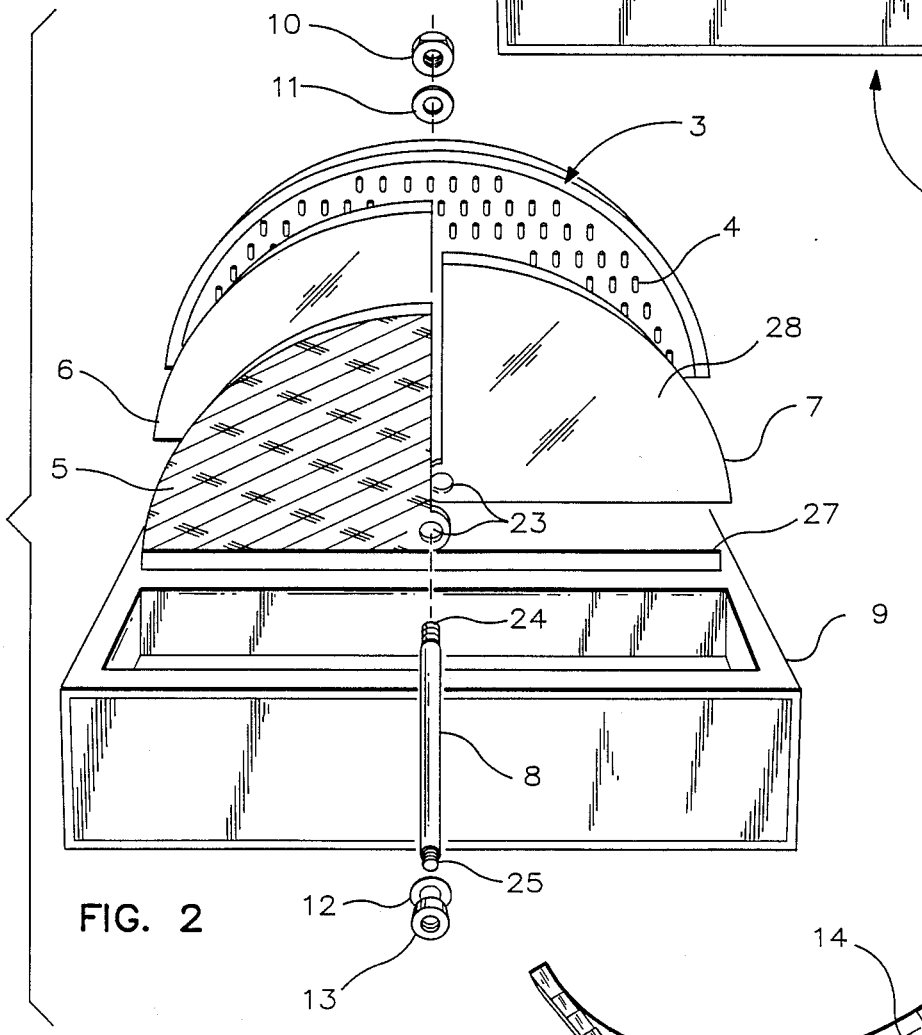
FIG. 2 is a top front perspective exploded view of the earring storage device with the cover removed.

Referring to FIG. 1, an earring storage device 1 is shown with a rectangular boxlike base 9 with a chamber 20 extending from a top surface 21 of the rectangular boxlike base 9. There is shown in FIG. 2 three quarter-sections 5,6 and 7 of a circular rigid disk. Also shown is a half-section 3 of a circular rigid disk. Half-section 3 is attached and normal to base 9 as shown in FIG. 1. There are a plurality of pins 4 attached to a surface 22 of half-section 3. These pins 4 are attached to surface 22 at an upward angle to surface 21 as shown in FIG. 1. There is a hole (not shown but in line with the holes of the quarter-sections when device 1 is assembled) near the vertex of the half-section. FIG. 2 shows the hole 23 near the vertex (point from which an angle originates) of the quarter-sections.

A shaft 8 passes through the hole in the hole in the half-section and through the holes 23 in the quarter-section. The quarter-sections can be rotated around the shaft 8 in approximately an 180 degree arc. The shaft 8 may be fastened to half-section 22 by a fastening means such as nut 10 and washer 11 on a first end 24 shown in FIG. 2. A knob 13 and a washer 12 may be placed on a second end 25 of shaft 8. Knob 13 can be used to rotate shaft 8 and quarter-sections 5, 6 and 7 if desired or the quarter-sections may be rotated individually by hand around shaft 8.

Figure 3:
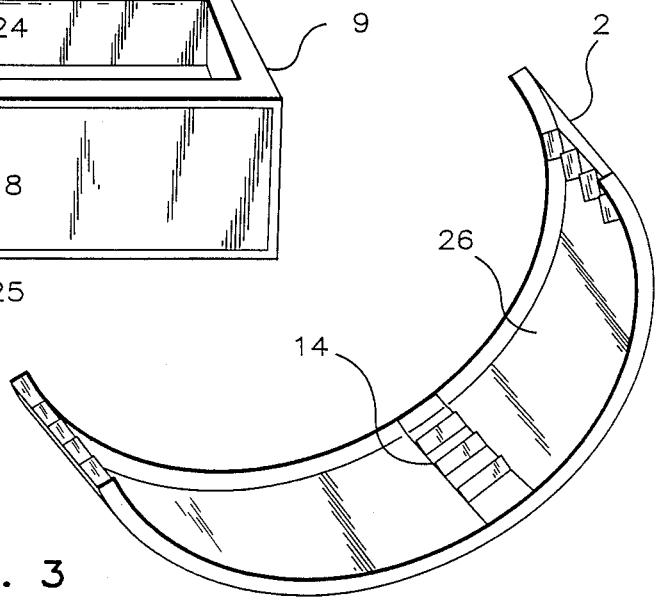
FIG. 3 is a top perspective view of the inverted earring storage device cover.

A semicircular cover 2 is attached to the top surface 21 of the rectangular boxlike base 9 and the cover 2 extends around the quarter-sections. To facilitate rotation of the quarter-sections, the radius of the quarter-sections is less than the inside radius of the arc formed by the semicircular cover 2 as it is attached to the top surface 21 of base 9. These ar a plurality of semicircular spacer tracks 14 (shownin FIG. 3) affixed to the inside perimeter 26 of the semicircular cover 2 for guiding and for providing axial spacing between the quarter-sections 5, 6 and 7. There may also be a tab 27 affixed and normal to the top surface 21 to assist in blocking forward movement of quarter-section 5 and to provide a location point for placing cover 2 on the surface 21.

At least one of the quarter-sections such as quarter-section 7, shown in FIG. 2, may have a magnetic surface 28. At least one of the quarter-sections such as quarter-section 5, shown in FIG. 2, may be made out of compressed fiber or cork.

I claim:

1. An earring storage device comprising:

a. a rectangular boxlike base;

b. a chamber extending from a top surface of the rectangular boxlike base;

c. a half-section of a circular rigid disk, with a plurality of pins attached to the half-section at an upward angle to the top surface of the base, attached and normal to the top surface with a hole near the vertex of the half-section;

d. a plurality of quarter-sections of a circular rigid disk having a hole near the vertex of the quarter-sections of the rigid disk;

e. a shaft that passes through the hole of the half-section and of each quarter-section and around which the quarter-sections may rotate;

f. a knob on an end of the shaft;

g. a semicircular cover attached to the top surface of the rectangular boxlike base and extending around the quarter-sections;

h. a radius of the quarter-sections being less than an inside radius of the semicircular cover; and i. a plurality of semi-circular spacer tracks affixed to an inside perimeter of the semicircular cover for guiding and for providing axial spacing between the quarter-sections.

2. An earring storage device as defined in claim 1 further comprising:

a. at least one quarter-section with a magnetic surface; and b. at least one quarter-section made of compressed fiber or cork.

* * * * *